US005988920A

United States Patent [19]

Kunkler et al.

[11] Patent Number: 5,988,920

[45] Date of Patent: Nov. 23, 1999

[54] CLEANING IMPLEMENT HAVING A PROTECTED PATHWAY FOR A FLUID TRANSFER TUBE

[75] Inventors: Jeffery Scott Kunkler, Chicago, Ill.; Arnold George Benecke, Indian Springs, Ohio

[73] Assignee: The Procter & Gamble Company, Cincinnati, Ohio

[21] Appl. No.: 09/201,620

[22] Filed: Nov. 30, 1998

[51] Int. Cl.[6] ..... A47L 13/22

[52] U.S. Cl. ..... 401/138; 401/139; 401/140; 239/587.5

[58] Field of Search ..... 401/139, 138, 401/140; 239/532, 587.5

[56] References Cited

U.S. PATENT DOCUMENTS

| | | | |
|---|---|---|---|
| D. 396,908 | 8/1998 | Beechuk et al. | D32/45 |
| D. 401,703 | 11/1998 | Beechuk et al. | D32/45 |
| 1,715,632 | 6/1929 | Wertheimer . | |
| 2,053,282 | 9/1936 | Gewalt . | |
| 2,137,944 | 11/1938 | MacLeod . | |
| 2,187,671 | 1/1940 | Suddarth . | |
| 2,470,837 | 5/1949 | Polson . | |
| 2,618,799 | 11/1952 | Barbato . | |
| 3,094,152 | 6/1963 | Kenny et al. . | |
| 3,099,028 | 7/1963 | Ardito . | |
| 3,188,669 | 6/1965 | Beardslee . | |
| 3,278,974 | 10/1966 | Nighswander . | |
| 4,119,386 | 10/1978 | Cushing | 401/138 |
| 4,299,262 | 11/1981 | Andrepont | 141/387 |
| 4,507,004 | 3/1985 | Moffitt, Jr. | 401/138 X |
| 4,747,518 | 5/1988 | Laauwe | 222/153 |
| 4,863,299 | 9/1989 | Osberghaus et al. | 401/15 |
| 4,971,471 | 11/1990 | Sloan | 401/203 |
| 5,092,699 | 3/1992 | Silvenis | 401/21 |
| 5,244,124 | 9/1993 | Raffo | 222/325 |
| 5,472,122 | 12/1995 | Appleby | 222/212 |
| 5,636,402 | 6/1997 | Kubo et al. | 15/98 |
| 5,735,959 | 4/1998 | Kubo et al. | 118/663 |
| 5,888,006 | 3/1999 | Ping et al. | 401/137 |

FOREIGN PATENT DOCUMENTS

| | | | |
|---|---|---|---|
| 65044 | 1/1990 | Canada . | |
| 1269210 | 5/1990 | Canada . | |
| 2225303 | 6/1998 | Canada . | |
| 58-9637 | 1/1983 | Japan | 401/140 |

*Primary Examiner*—Steven A. Bratlie
*Attorney, Agent, or Firm*—Elizabeth M. Koch; James C. Vago

[57] ABSTRACT

A cleaning implement has a reservoir, a dispenser and a fluid transfer tube. The reservoir retains a cleaning fluid and preferably is attached to a collapsible handle. The dispenser is attached to the reservoir by a universal joint which comprises a ball and fork configuration. The fluid transfer tube is connected to the reservoir in open communication with the dispenser, wherein the fluid transfer tube is positioned within the ball of the universal joint to prevent the fluid transfer tube from becoming entangled with the universal joint.

10 Claims, 3 Drawing Sheets

CLEANING IMPLEMENT HAVING A PROTECTED PATHWAY FOR A FLUID TRANSFER TUBE

FIELD OF THE INVENTION

The present invention relates to the field of cleaning implements, and more particularly to a collapsible cleaning implement having a universal joint which encases and protects a fluid transfer tube within the universal joint, wherein the fluid transfer tube transports fluid from a reservoir on the cleaning implement to a sprayer nozzle on the cleaning head.

BACKGROUND OF THE INVENTION

Cleaning implements are known, particularly cleaning implements having a mop head attached to a handle by a universal joint. Typically, these cleaning implements have a fluid reservoir attached to the handle and which dispense fluid to the cleaning head using a fluid transfer tube. However, these conventional cleaning implements attach the fluid transfer tube along the exterior of the mop, specifically, the exterior of the universal joint. In this way, the fluid transfer tube can become entangled in the universal joint and inhibit the movement of the mop head. In addition, the fluid transfer tube may become pinched or crimped by the universal joint and restrict, or completely block, the fluid transfer tube. As a result, conventional cleaning implements which utilize a universal joint and an external fluid transfer tube can have limited movement of the mop head and/or restricted fluid flow to the cleaning head.

In addition, most conventional cleaning implements utilize a handle having a straight shaft which is not collapsible or foldable. This significantly limits the ability to transport the cleaning implement using minimal space. In addition, the user is unable to manipulate the handle for smaller cleaning spaces and/or for storage.

Therefore, what is needed is a cleaning implement having a collapsible handle and a universal joint which encases the fluid transfer tube within the universal joint to prevent the transfer tube from inhibiting the movement of the universal joint, and subsequently the mop head, and to prevent the fluid transfer tube from becoming crimped and restricting fluid flow to the mop head.

SUMMARY OF THE INVENTION

It is an object of the present invention to provide an improved cleaning implement.

It is a further object of the present invention to provide a collapsible cleaning implement, comprising a reservoir for retaining a fluid, a dispenser attached to the reservoir by a universal joint, and a fluid transfer tube connected to the reservoir in open communication with the dispenser, wherein the fluid transfer tube is positioned within the universal joint to prevent the fluid transfer tube from becoming entangled with the universal joint.

DETAILED DESCRIPTION

Figure 1A:
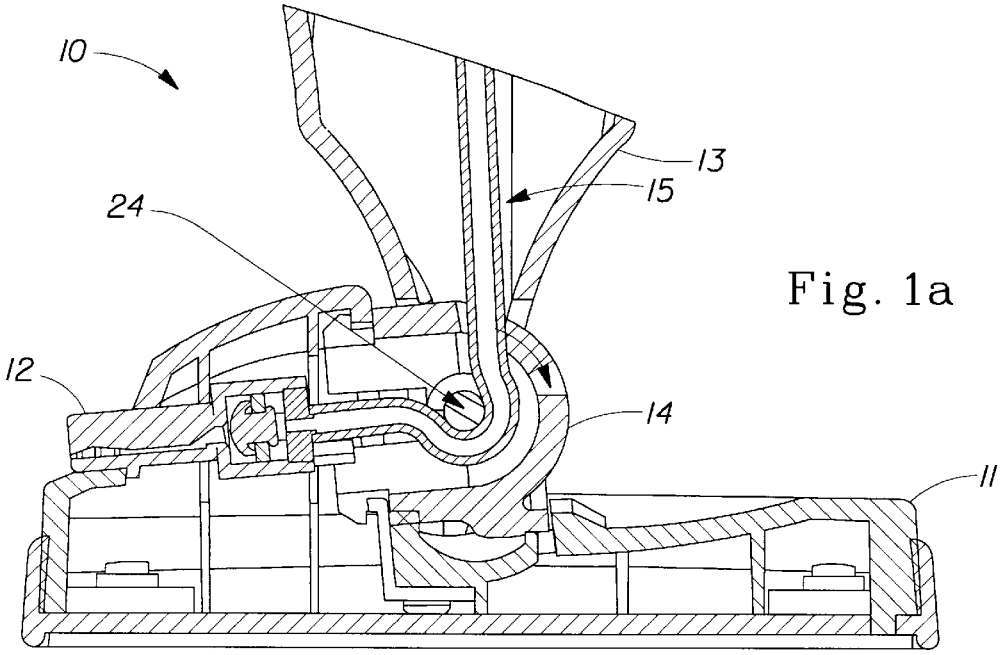
FIG. 1*a* and 1*b* are a cross-sectional view (FIG. 1*a*) of the preferred cleaning implement having a ball (FIG. 1*b*) and fork universal joint with a protected pathway for a fluid transfer tube according to the preferred embodiment of the present invention.

Referring to FIGS. 1–4, the preferred cleaning implement 10 comprises a mop head 11 having a dispenser 12 attached to a fluid reservoir 13 by a universal joint 14. The reservoir 13 is in open communication with the dispenser 12 via a fluid transfer tube 15. The reservoir 13 preferably includes a handle 16 but may be used without a separate handle without deviating from the intent of the invention. In addition, the preferred dispenser 12 is a sprayer nozzle but may comprise a variety of dispensers without deviating from the intent of the invention.

The universal joint 14 comprises a substantially hollow ball 17 (FIG. 1*a*) and a fork 18 (FIG. 2) for retaining the ball 17 using a pin 19 and providing a pathway 20 for the fluid transfer tube 15. Preferably, the ball 17 is attached to the mop head I 1 while the fork 18 is attached to the reservoir 13. However, alternatively, the ball 17 may be attached to the reservoir 13 and the fork 18 may be alternately attached to the mop head 11.

Figure 1B:
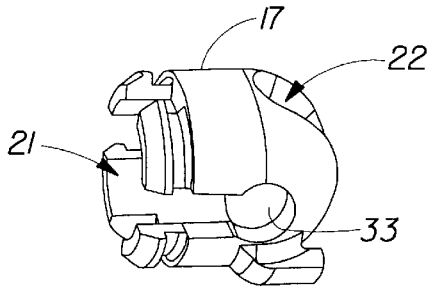
Figure 2A:
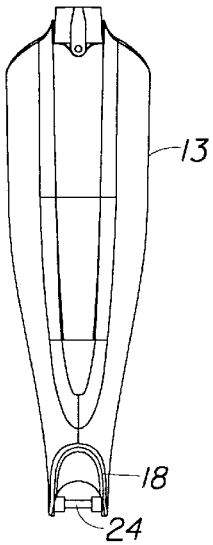
FIG. 2*a*–2*c* is a front, cross-sectional and bottom view of the preferred universal joint fork according to the present invention.
Figure 2B:
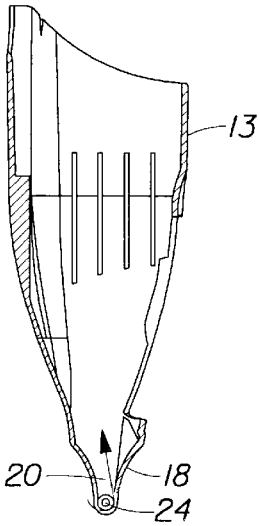
Figure 2C:
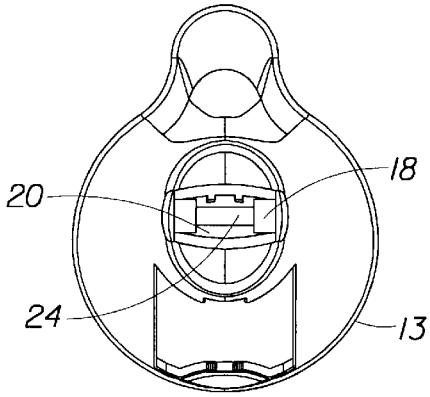

Referring to FIG. 1*b*, the ball 17 preferably has a truncated face 21 which snappingly engages the mop head 11, a slot 22 for receiving the tube 15 and a through opening 23 for engaging a connecting pin 24 of the fork 18. The truncated face 21 provides an opening for the tube 15 to pass and connect to the sprayer nozzle 12. The slot 22 in the back of the ball 17 provides the passageway to guide the tube 15 as the fork 18 is rotated about the pin 24. The fork 18 is attached to the ball 17 by the connecting pin 24 and pivots about the axis created by the pin 24. The universal joint 14, specifically the slot 22 of the ball 17, provides an unobstructed passageway through the joint 14 for the tube 15 to pass without inhibiting the movement of the universal joint 14 or the fork 18. During rotation, the fork 18 guides the tube 15 up or down within the slot 22 of the ball 17 to allow movement of the cleaning implement 10 without pinching or kinking of the tube 15.

Figure 3A:
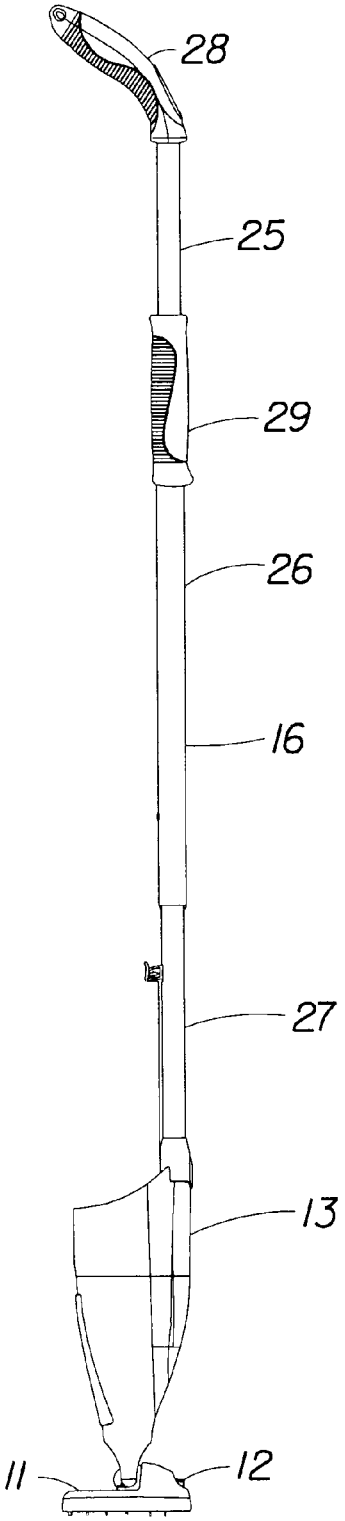
FIG. 3*a* and 3*b* are side views of the preferred cleaning implement with the handle in the assembled (FIG. 3*a*) and collapsed and folded (FIG. 3*b*) state according to the present invention.
Figure 3B:
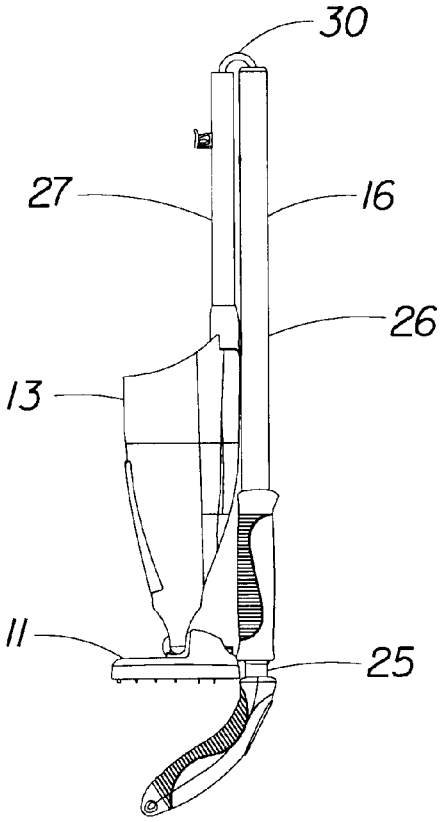

Referring to FIG. 3, the handle 16 preferably comprises an upper, middle and lower telescoping sections 25, 26, and 27, respectively. The upper section 25 is positioned between a primary grip 28 and a secondary grip 29 and collapses telescopically into the middle section 26. The middle section 26 is positioned between the other two sections 25 and 27 and is preferably larger in diameter than the sections 25 and 27. The middle section 26 can be separated from the lower section 27 and folded over as shown in FIG. 3*b*. The upper section 25 and middle section 26 remain connected by a wiring harness 30 which is preferably connected to the primary grip 28 and the dispenser 12 and is exposed in the folded state (FIG. 3*b*). The wiring harness 30 has sufficient slack to enable the sections 25, 26 and 27 to be disengaged without exposing the wiring harness 30 unnecessarily. The lower section 27 is positioned between the reservoir 13 and the middle section 26. In this manner, the handle 16 of the cleaning implement 10 may be collapsed from the assembled state (FIG. 3*a*) to the collapsed and folded state (FIG. 3*b*).

Figure 4A:
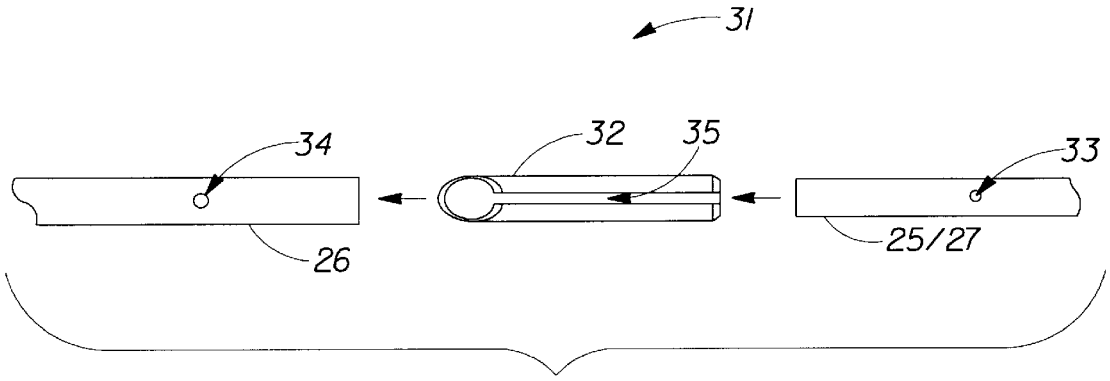
FIG. 4*a*–4*c* are assembled (FIG. 4*a*), unassembled (FIG. 4*b*) and cross-sectional (FIG. 4*c*) views of the preferred joint between the upper and middle sections and middle and lower sections of the handle according to the present invention.
Figure 4B:
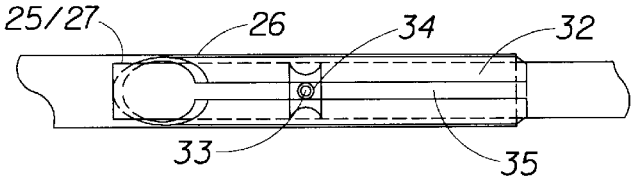
Figure 4C:
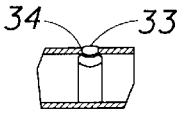

Referring to FIG. 4, the preferred joint 31 is illustrated in the unassembled (FIG. 4*a*) and assembled (FIG. 4*b*) state. The preferred joint comprises a bushing 32 which is inserted in each end of the middle section 26 using a press fit and provides a wobble free connection between the sections 25, 26 and 27. The upper and lower sections 25 and 27 each have a spring loaded locking pin 33 which lockingly engages an opening 34 such that the pin 33 protrudes through the opening 34 as shown in FIG. 4*c* when the pin 33 and the opening 34 are axially aligned.

To lock the handle 16 in place as shown in FIG. 3*a*, the upper and lower sections 25 and 27 are inserted within the bushing 32 of the middle section 26 such that the pin 33 engages a slot 35 of the bushing 32. The slot 35 guides the spring loaded pin 33 into the opening 34 which allows the pin 33 to lockingly engage the opening 34. To disengage the upper and lower sections 25 and 27 from the middle section 26, the pin 33 is depressed from the opening 34 while the upper and lower sections 25 and 27 are slideably removed from the middle section 26.

While the embodiment of the invention shown and described is fully capable of achieving the results desired, it is to be understood that this embodiment has been shown and described for purposes of illustration only and not for purposes of limitation. Other variations in the form and details that occur to those skilled in the art and which are within the spirit and scope of the invention are not specifically addressed. Therefore, the invention is limited only by the appended claims.

What is claimed:

1. A cleaning implement, comprising:

a reservoir for retaining a fluid;

a dispenser attached to said reservoir by a universal joint; and a fluid transfer tube connected to said reservoir in open communication with said dispenser, wherein said fluid transfer tube is positioned within said universal joint to prevent said fluid transfer tube from becoming entangled with said universal joint.

2. The cleaning implement of claim 1, further comprising a mop head attached to said universal joint, wherein said dispenser is attached to said mop head.

3. The cleaning implement of claim 1, wherein said universal joint comprises a ball and fork, wherein said ball is positioned within said fork for allowing said dispenser to rotate in all directions.

4. The cleaning implement of claim 1, wherein said dispenser comprises a sprayer nozzle.

5. The cleaning implement of claim 1, further comprising a handle attached to said universal joint, wherein said reservoir is attached to said handle.

6. The cleaning implement of claim 5, wherein said handle comprises at least two telescoping members.

7. The cleaning implement of claim 5, wherein said handle is at least one of collapsible and foldable.

8. The cleaning implement of claim 5, wherein said handle comprises an upper section, a middle section, and a lower section, said middle section having a larger diameter than said upper and lower sections.

9. The cleaning implement of claim 8, wherein at least one of said upper and lower sections have a spring loaded pin which lockingly engage an opening of said middle section.

10. The cleaning implement of claim 9, wherein said upper and lower sections are attached to said middle section using a press fit bushing having a guide slot for guiding said pin into said opening of said middle section.

* * * * *